US007068232B2

(12) United States Patent
Duncan et al.

(10) Patent No.: US 7,068,232 B2
(45) Date of Patent: Jun. 27, 2006

(54) ANTENNA MOUNTING SYSTEM AND KIT

(75) Inventors: Lee A. Duncan, Gilford, NH (US); Michael B. Metz, Laconia, NH (US)

(73) Assignee: Metz Communications, Inc., Laconia, NH (US)

( * ) Notice: Subject to any disclaimer, the term of this patent is extended or adjusted under 35 U.S.C. 154(b) by 0 days.

(21) Appl. No.: 10/891,707

(22) Filed: Jul. 15, 2004

(65) Prior Publication Data

US 2006/0012534 A1 Jan. 19, 2006

(51) Int. Cl.
*H01Q 1/32* (2006.01)
*H01Q 3/02* (2006.01)

(52) U.S. Cl. ..... 343/715; 343/882; 343/888

(58) Field of Classification Search ..... 343/715, 343/882, 888, 709, 878, 892, 880
See application file for complete search history.

(56) References Cited

U.S. PATENT DOCUMENTS 2,878,303 A * 3/1959 Zacher ..... 174/153 A
5,402,135 A * 3/1995 DeMarre et al. ..... 343/715
5,661,497 A * 8/1997 Calearo ..... 343/715
5,896,110 A * 4/1999 Kojima ..... 343/715
6,023,247 A * 2/2000 Rodeffer ..... 343/765
6,063,459 A * 5/2000 Velte ..... 428/31
6,608,597 B1 * 8/2003 Hadzoglou et al. ..... 343/713

* cited by examiner

*Primary Examiner*—HoangAnh Le
*Assistant Examiner*—Tung Le
(74) *Attorney, Agent, or Firm*—Michael J. Persson; Lawson & Persson, PC

(57) ABSTRACT

An antenna mounting system including a base plate having a mounting surface, a substantantially circular opening through the mounting surface, and attachment means for attaching the base plate to a mounting surface. The housing and the base plate are each dimensioned such that the housing is substantially rotatable within the base plate when the base plate is loosely attached to the mounting surface and such that the housing is substantially fixed when the base plate is tightly attached to the mounting surface. A rotator portion of a rotatable connector is disposed within the housing and is rotatably and controllably attached thereto. A connector portion extends through a slot in the housing and includes a cable connector and a sealing surface dimensioned to mate with an antenna.

20 Claims, 4 Drawing Sheets

ANTENNA MOUNTING SYSTEM AND KIT

FIELD OF THE INVENTION

The present invention relates to the field of vehicle antenna mounting systems and, in particular, to antenna systems that allow the orientation of the antenna to be adjusted.

BACKGROUND OF THE INVENTION

The greatest modern advance in marine technology is the advent of signaled communication. Navigation at sea, unlike on land, must proceed without benefit of landmarks; one portion of water typically looks exactly like the portion of water beside it. A vessel's communication and means for locating itself were once restrained by the distance that the sailors on board could see. Eventually man created instruments that would determine location based on the earth's magnetic field and the celestial bodies, and originated symbols (flags, smoke, etc.) to convey simple messages to vessels in sight. Now global positioning satellite systems have replaced the compass and astrolabe; antennas have replaced signal flag communication. Electronic signaling, if not always vital, is always convenient, and communication equipment should be protected and positioned to operate with the highest efficiency.

One problem common to antennas is the problem of mounting the antenna to the vessel. Vessel hulls are typically devoid of suitable flat surfaces, necessitating that the antenna be mounted in an orientation other than a desired orientation. However, most commercially available antenna mounts, West Marine Models 4194 and 4193 for example, fail to include any means of positioning the antenna in a desired orientation.

A small number of specialized antenna mounts have been developed to overcome this problem. One such antenna mount is shown in described in U.S. Pat. No. 5,512,912 ('012), issued Apr. 30, 1996, which purports to describe an antenna mount that includes a two axis gimbaled mounting, which allows the antenna to rotate in two axes. A pendular mass is provided to maintain the antenna in a particular orientation in the absence of any externally applied acceleration. A chamber is provided attached to the pendular mass for holding a viscous dampening fluid. The dampening fluid allows the antenna mount to rotate in response to an externally applied acceleration but serves to dampen any oscillations induced by an externally applied acceleration. The antenna mount maintains the antenna in substantially a predetermined position despite the influence of externally applied accelerations. Shock absorbers may be supplied to the gimbal mounting to aid in the dampening of large accelerations.

The '912 patent describes a marine mount primarily concerned with combating the effects of acceleration on a sea craft. Though perhaps an effective way to negate water-created turbulence, the mount of '912 patent includes multiple disadvantages. The mount is bulky; it must include not only a pendulum, but also the necessary unfettered swinging space—i.e. a chamber. Because the mount swings in use, it must be distanced from other structures. This distance is achieved by use of an attachment arm, which will often be structural excess that creates an unfavorable profile. Further, this mount fails to include any means for easily changing the orientation of the antenna to a substantially horizontal position, which is necessary in circumstances where the vessel must pass under a bridge or be transported across land.

At least one commercially available antenna mount addresses both the issue mounting the antenna in a desired orientation and changing the orientation when mandated by particular circumstances. West Marine Model 4187 antenna mount includes ratcheting mechanisms that allows the antenna to be adjusted in two directions. However, this mount has a number of drawbacks. First, it has an ungainly profile, similar to that of the mount described in the '912 patent. In addition, the mount does not include any protection of the antenna cable from exposure to the elements, rendering it susceptible to corrosion. Finally, the design of this mount renders it incompatible with lower cost materials, such as plastics, resulting in it either being manufactured from expensive materials, such as stainless steel, or inexpensive but corrodible materials, neither of which may be altered to better suit the aesthetics of the vessel.

Therefore, there is a need for a marine antenna mount that is capable of adjusting an antenna to a desired orientation, that may be easily adjusted to a substantially horizontal orientation when conditions mandate such an adjustment, that has a low-profile, that protects the cable and cable connections from corrosion, and that can be manufactured from relatively low cost materials that may be colored to suit the aesthetics of the vessel.

SUMMARY OF THE INVENTION

The present invention is an antenna mounting system and kit that overcome the above-mentioned drawbacks inherent in prior art antenna mounts.

In its most basic form, the antenna mounting system includes a base plate having a mounting surface, a substantantially circular opening through the mounting surface, and attachment means for attaching the base plate to a mounting surface. A housing extends through the circular opening in the base plate and rotatable therein. The housing has a substantially hollow interior defined by an interior surface, a bottom, and a top through which a slot is disposed. The housing and the base plate are each dimensioned such that the housing is substantially rotatable within the base plate when the base plate is loosely attached to the mounting surface and such that the housing is substantially fixed when the base plate is tightly attached to the mounting surface. The system also includes a rotatable connector made up of a rotator portion and a connector portion. The rotator portion of the rotatable connector is disposed within the interior of the housing and rotatably attached thereto by a means for controlling a rotation of the rotator portion of the rotatable connector within the housing. The connector portion extends through the slot in the housing and includes a cable connector and a sealing surface dimensioned to mate with an antenna.

In the preferred embodiment of the system, the base plate includes a race disposed within the mounting surface and the housing includes a flange dimensioned to mate with the race such that the base plate captures the housing. The preferred embodiment also includes a gasket manufactured of a compressible material that is dimensioned to extend about the mounting surface of the base plate. In the preferred embodiment, the gasket is a 3/16 inch thick closed cell neoprene gasket that has a shape substantially similar to that of the mounting surface of the base plate. In this embodiment, the flange has a thickness that is greater than the sum of the depth of the race and a fully compressed thickness of the gasket but less than the sum of the depth of the race and an uncompressed thickness of the gasket such that the housing is substantially rotatable within the base plate when the base plate is loosely attached to the mounting surface and such that the housing is substantially fixed, and the gasket creates a substantially water resistant seal, when the base plate is tightly attached to the mounting surface.

In the preferred mounting system, the attachment means for attaching the base plate to the mounting surface includes at least two holes disposed through the base plate and at least two mechanical fasteners, preferably mounting bolts and nuts, that are dimensioned for insertion through the holes. The mechanical fasteners are adapted to be readily loosened and tightened, allowing the housing to be easily freed, rotated, and re-secured.

In the preferred system, the housing includes a bolt opening and a fastener opening therethrough and the rotator portion of the rotatable connector includes a bolt hole therethrough. These openings and hole are aligned such that they accept a bolt dimensioned to extend through the bolt opening and the bolt hole, and a threaded fastener dimensioned to extend through the fastener opening and contact the rotator portion of the rotatable connector proximate to the bolt hole. In this preferred embodiment, the housing, the bolt and the threaded fastener are each dimensioned such that tightening the bolt and the fastener causes the fastener to be drawn against the rotator portion such that the rotator portion is wedged between the threaded fastener and the interior of the housing.

The preferred system also includes a cable that is fixedly connected to the cable connector and sealed within the connector portion of the rotatable connector. In the embodiment, the rotator portion of the rotatable connector includes a notch therein and the cable extends from the connector portion through the rotatable portion and exits the rotatable connector through the notch.

It is preferred that at least the base plate and the housing be manufactured of a marine grade plastic material that is resistant to ultraviolet radiation and is capable of being pigmented to produce a base plate and housing having a desired color.

Finally, some embodiments of the system also include an antenna. In these embodiments, it is preferred that the cable connector have a male threaded end, that the antenna include a female threaded connector that is mated with the male threaded end of the cable connector, and that a gasket is disposed between the antenna and the sealing surface of the connector portion of the rotatable connector. However, in other such embodiments, the antenna is an integral part of the rotatable connector.

The kit of parts of the present invention includes all of the components of the mounting system, but is not provided in assembled form. Accordingly, the particulars of the kit are not separately described herein.

Therefore, it is an aspect of the invention to provide an antenna mount that is capable of adjusting an antenna to a desired orientation.

It is a further aspect of the invention to provide an antenna mount that may be easily adjusted to a substantially horizontal orientation when conditions mandate such an adjustment.

It is a further aspect of the invention to provide an antenna mount that has a low-profile.

It is a further aspect of the invention to provide an antenna mount that is substantially water resistant such that water is prevented from contacting the antenna and cable connections.

It is a further aspect of the invention to provide an antenna mount that can be manufactured from relatively low cost materials.

It is a further aspect of the invention to provide an antenna mount that may be colored to suit the aesthetics of the vessel.

It is a further aspect of the invention to provide an antenna mount that is lightweight.

These aspects of the invention are not meant to be exclusive and other features, aspects, and advantages of the present invention will be readily apparent to those of ordinary skill in the art when read in conjunction with the following description, and accompanying drawings.

DETAILED DESCRIPTION OF THE INVENTION

Figure 1:
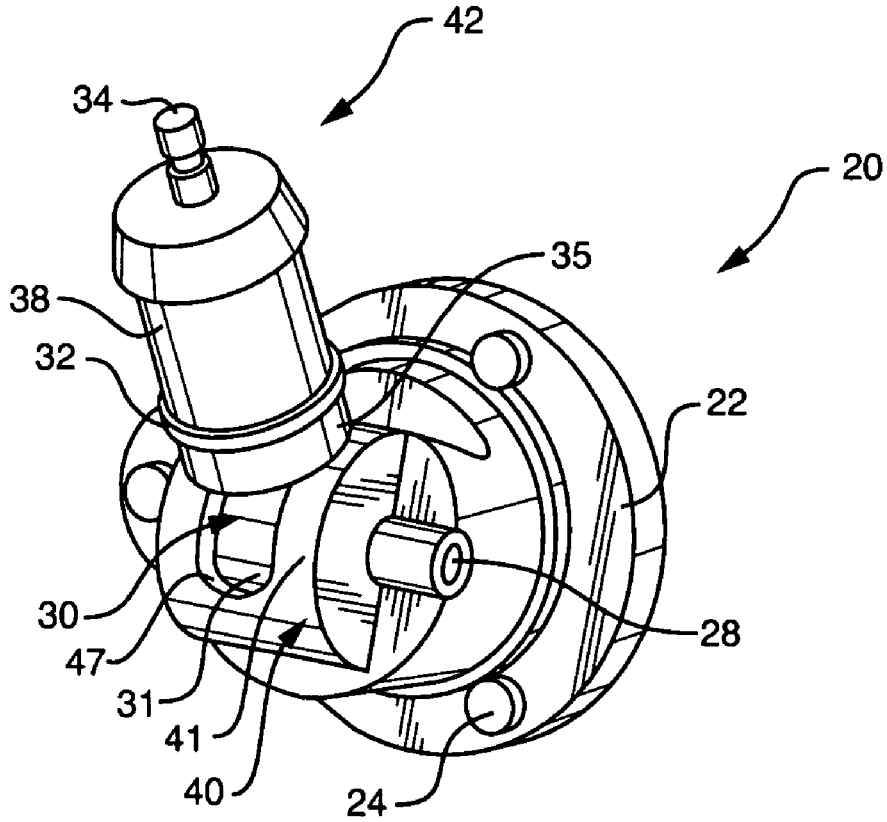
FIG. 1 is a top isometric view of preferred antenna mounting system of the present invention to which an antenna is mounted.
Figure 2:
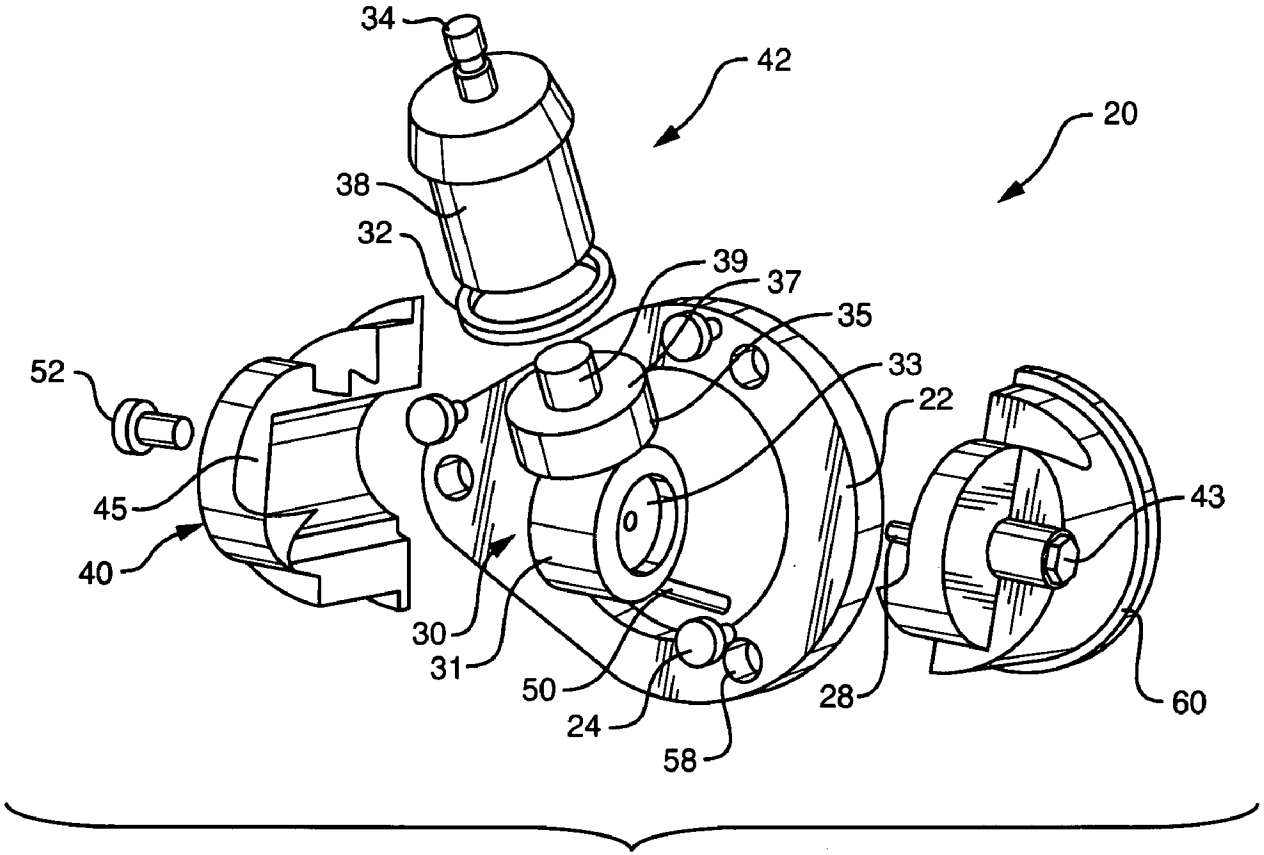
FIG. 2 is a top isometric assembly view of the preferred antenna mounting system of FIG. 1.
Figure 3:
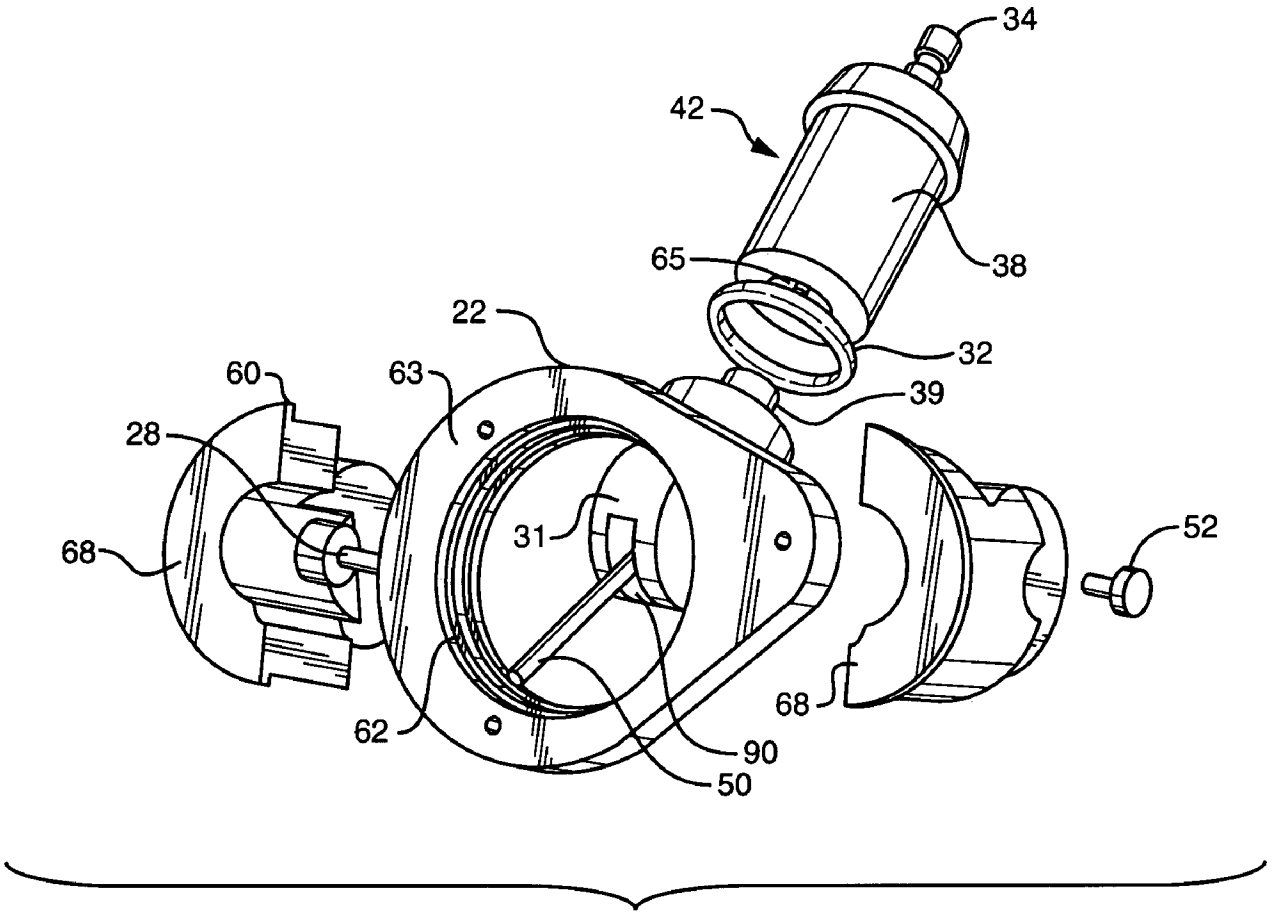
FIG. 3 is a bottom isometric assembly view of the preferred antenna mounting system of FIGS. 1 & 2.

Referring to FIGS. 1–3, a preferred version of the antenna mounting system 20 is shown with an antenna 42 mounted thereto. The antenna mounting system 20 includes a base plate 22 that is mounted to a mounting surface, such as a vessel hull 94, a housing 40, and a rotatable connector 30. The housing 40 is rotatable within the base plate 22 allowing the orientation of the antenna 42 to be moved through a plane parallel to the plane of formed by the junction of the base plate and the vessel. The rotatable connector 30 joins the antenna 42 to the mounting system 20 and extends from, and is rotatable within, the housing 40 along a plane that is substantially perpendicular to the plane of rotation of the housing 40 within the base plate 22. Accordingly, the antenna mounting system 20 allows the antenna 42 to be fully adjusted along in two axes, allowing it be positioned in a wide range of orientations.

As shown in detail in FIG. 3, the housing 40 preferably rotates within the base plate 22 due to the mating of a flange 60 about the bottom 68 of the housing 40 and a race 62 formed in the bottom surface 63 of the base plate 22. During assembly, the flange 60 of the housing 40 is mated with race 62 in the base plate 22, a gasket 27 is preferably aligned with the bottom surface 68 of the base plate 22 and the base plate 22 is attached to the vessel hull 94. It is preferred that the gasket 27 be a 3/16 inch thick closed cell neoprene gasket 27 that has a shape substantially similar to that of the mounting surface of the base plate. However, gaskets 27 manufactured of other art recognized materials may be substituted to achieve similar results. The flange 60 of the housing 40 is dimensioned to mate to the race 62 in the base plate 22 such that, once attached to the hull 94, the base plate 22 will capture the housing 40, limiting all movement of the housing except for rotational movement. The flange 60 and race 62 are also dimensioned to allow the housing 40 to rotate easily when the base plate 22 is loosely attached to the vessel hull 94, while creating an interference fit that prevents such rotation when the base plate 22 is fully tightened against the hull 94. In embodiments utilizing a gasket 27, the flange 60 may be made thicker to make up for the increased height of the race 62 from the mounting surface, while the flange may be made to be only slightly thicker than the depth of the race 62 in embodiments in which the gasket 27 is eliminated.

As shown in FIGS. 1 and 2, the preferred base plate 22 has a teardrop shape with rounded edges. This form was chosen due to its aerodynamic properties and for aesthetic reasons, and it is recognized that base plates 22 of other shapes may also be used. The base plate 22 is preferably tightened against the hull 94 by a series of mounting bolts 24 that extend through holes 58 in the base plate through the vessel hull 94 and are secured by lock washers and nuts 92 disposed inside the vessel hull 94. The base plate 22 is preferably attached via mounting bolts 24 due to the ease with which they may be loosened and tightened. However, other art recognized mean of attachment that allow for easy loosening and tightening of a plate may be substituted to achieve similar results.

The rotatable connector 30 includes a cylindrical rotator portion 31 that is disposed within the housing 40 and a connector portion 35 that extends through a slot 47 in the top of the housing 40. The rotatable connector 30 is rotatably attached to the housing 40 via a bolt 28 and threaded fastener 52, which serve as the preferred means for controlling a rotation of the rotator portion 31 of the rotatable connector 30 within the housing 40. The bolt 28 and threaded fastener 52 each extend into the housing 40 through a bolt opening 43 and fastener opening 45, respectively, along a plane parallel to the plane of the base plate 22. The bolt 28 has a length and diameter that allow it to extend through the bolt opening 43 in the housing 40 and a bolt hole 33 through the side of the rotator portion 31 to mate with the threaded fastener 52, which extends within the housing 40 through the fastener opening 45. The rotator portion 31 is dimensioned to fit inside of the mating portion of the housing 40 such that the rotator portion 31 may be easily rotated within the limits of travel of the connector portion 35 within the slot 47 in the top of the housing 40 when the bolt 28 and fastener 52 are loosened, but preferably is not dimensioned to fit so loosely as allow significant amounts of water to enter the housing 40 through the gaps between the rotator portion 31 and the housing 40. When the antenna 42 is aligned in a desired orientation, the bolt 28 is tightened such that the fastener 52 is drawn against the side of the rotator portion 31, effectively wedging it between the fastener 52 and the inside of the housing 40 to prevent its further rotation and maintain the antenna 42 in its desired position.

Figure 4:
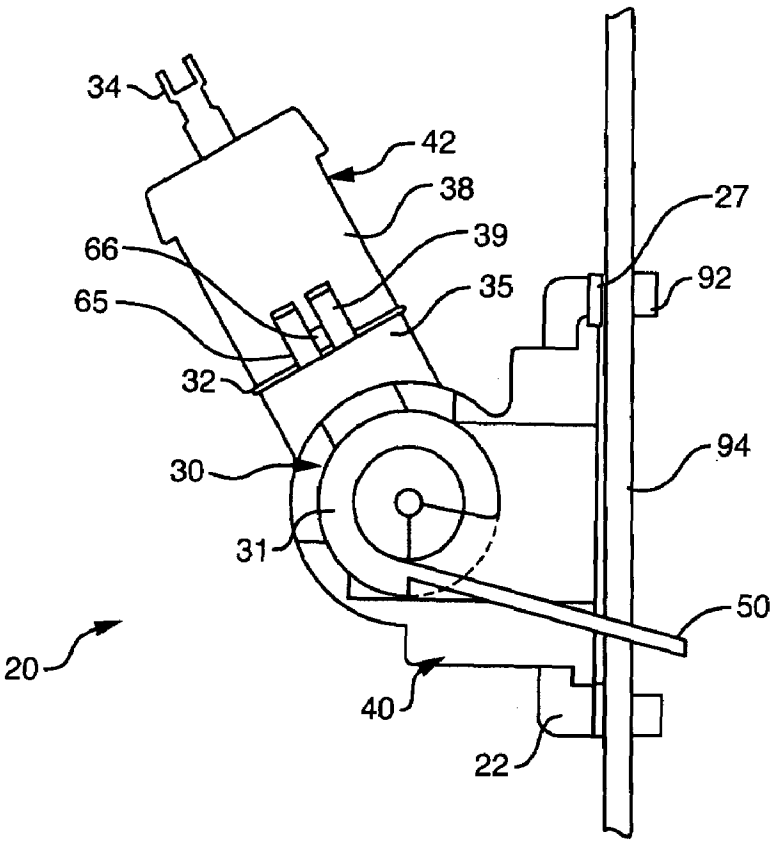
FIG. 4 is a partially cut away side view of the preferred antenna mounting system of FIGS. 1–3 showing the antenna wiring arrangement, gaskets and vessel hull.

Referring now to FIGS. 2–4, in addition to allowing the antenna 42 to be rotated, the connector portion 35 of the rotatable connector 30 serves as the connection between the antenna 42 and the cable 50 that attaches to the communications device (not shown). The preferred connector portion 35 includes a sealing surface 37 that is dimensioned to mate with the body 38 of the antenna 42 through a gasket 32, such that a watertight junction is formed between the antenna 42 and mounting system 20. A cable connector 39 extends from the sealing surface 37 and is dimensioned to mate with the threaded connection 65 in the body 38 of the antenna 42. It is preferred that the cable connector 39 be a standard antenna connector, such as a PL258 type connector, although it is recognized that the specific characteristics of the connector 39 will invariably be dictated by the requirements of the antenna 42 to which it is to attach. Regardless of its specific characteristics, the cable connector 39 is adapted to form an electrical connection 66 with the antenna 42.

The circuit between the antenna 42 and the communications equipment is completed by the cable 50, which runs between the cable connector 39 and the communications equipment. In the preferred embodiment, the cable 50 is a standard marine grade antenna cable, such as west Marine RG8X cable, which is soldered to the cable connector 39 to form a solid connection therewith. However, it is recognized that other art recognized cables or connection methods could be substituted to achieve similar results. The cable 50 extends into the rotator portion 31 of the rotatable connector 30 through an opening joining the connector portion 35 and rotator portion 31. In the preferred embodiment, the cable 50 then extends through a notch 90 in the rotator portion 31 and into the body of the housing 40, from which it passes through an opening in the vessel hull 94 and is connected to the communications equipment. The inclusion of a notch 90 through the rotator portion 31 is preferred as it allows the cable to pivot within the housing 40 when the rotatable connector 30 is rotated. However, other embodiments may simply include a bore through which the cable 50 extends, with additional slack length of cable being provided to allow for the rotation of the antenna 42. It is preferred that the cable 50 provided with the antenna mounting system 20 extend to a length of twelve feet in order to allow it to directly mount to most communication equipment without the need for multiple connections. However, other embodiments may provide a shorter cable 50 that is connected by intermediate cables to the equipment.

In the preferred embodiment, the cable connector 39 is connected to the cable 50 and is positioned within the mold (not shown) used to form the rotatable connector 30. Plastic is then injected within the mold and the rotatable connector 30 is formed with the cable connector 39 and cable 50 encapsulated therein. This method is preferred as it insures that the connection between the cable connector 39 and cable 50 is waterproof. However, in other embodiments, both the rotator portion 31 and sealing surface 39 of the connector portion 35 of the rotatable connector 30 are manufactured of molded plastic and are formed together as two halves, perpendicularly arranged with respect to the hole 33 through which bolt 28 passes, and are joined together during assembly of the mounting system 20. During assembly, the cable connector 39 is connected to the cable 50 and is positioned within the two halves of the rotatable connector 30 such that the cable connector 39 extends from the sealing surface 37 and the cable 50 extends from the rotator portion 31. A potting compound is disposed about the cable connector 39 and cable 39 and the two halves are then brought together and joined, effectively securing and sealing the cable connector 39 and cable 50 within the rotatable connector 30.

In the preferred embodiment of the invention, the housing 40, base plate 22 and the molded portions of the rotatable connector 30 are each formed of a marine grade plastic material that is resistant both to corrosion and to ultraviolet radiation. The use of such plastics has a number of advantages. Such materials offer the same, or better, corrosion resistance as stainless steel, which has higher material and manufacturing costs associated therewith. Further, many such materials may be pigmented to allow the color of the mounting system 20 to be coordinated with the colors or decor of the vessel to which it is to be mounted. Finally, such plastics are substantially lighter in weight than metallic materials; making them attractive in vessels, such as racing sailboats, where overall vessel weight is important.

The preferred embodiment of the antenna mounting system 20 of the present invention is effective at preventing the ingress of water to the conductive portions of the antenna 42 and cable 50. This water resistance is accomplished in three ways. First, soldering the cable 50 to the cable connector 39 and embedding it with the rotatable connector 30 seals the connection between the cable 50 and cable connector 39 with a layer of plastic. Second, the gasket 32 between the sealing surface 37 of the connector portion 35 and the antenna 42 prevents ingress to the connection 66 formed between the antenna 42 and the cable connector 39. Finally, in the preferred embodiment, the gasket 27 between the base plate 22 and vessel hull 94 prevents water from seeping into the housing through voids between the vessel hull 94 and the bottom surface 63 of the base plate 22. Such protection of the conductive portions of the antenna 42 and cable 50 in an adjustable antenna mounting system 20 is unique to the present invention and, as explained above, offers significant advantages over current systems.

It is envisioned that the antenna mounting system 20 will be sold in kit form and assembled by the end user. The basic embodiment of the kit includes the base plate 22, housing 40, rotatable connector 30, bolt 28 and threaded fastener 52. The rotatable connector 30 preferably includes a length of cable 50 soldered thereto. However, some embodiments of the kit may simply include a rotatable connector 30 having a threaded connector 39 with threaded ends extending both from the sealing surface 37 and into the rotator portion 31 for connection to a standard cable nut. The preferred kit also will include the gasket 27 and mounting bolts 24 for mounting the base plate 22 to the vessel hull 94, as well as the o-ring 32 for sealing between the sealing surface 37 and the antenna 42. The preferred embodiments of the antenna mounting system 20 and kit do not include the antenna 42, which must be supplied by the user. However, it is recognized that the antenna 42 could be supplied along with the mounting system 20 or kit for mounting thereto. It is likewise recognized that the antenna 42 could be manufactured as an integral part of the rotatable connector 30 of the mounting system 20. Regardless of whether or not it is supplied, the antenna 42 is preferably a marine grade antenna, such as the Manta 6 VHF Masthead antenna sold by Metz Communications of Laconia, N.H., that has a cylindrical body 38 and includes a whip attachment 34 at its end. However, the mounting system 20 may be readily adapted to accommodate antennas 42 of other types and dimensions and, therefore, the invention should not be seen as being so limited.

Although the antenna mounting system has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. An antenna mounting system comprising:

a base plate comprising a bottom surface, a substantially circular opening through said bottom surface, and attachment means for attaching said base plate to a mounting surface;

a housing extending through said circular opening in said base plate and rotatable therein, said housing comprising a substantially hollow interior defined by an interior surface, a bottom, and a top through which a slot is disposed;

a rotatable connector comprising a rotator portion and a connector portion, wherein said rotator portion is disposed within said interior of said housing and is rotatably attached thereto, and wherein said connector portion extends through said slot in said housing and comprises a cable connector and a sealing surface dimensioned to mate with an antenna; and means for controlling a rotation of said rotator portion of said rotatable connector within said housing;

wherein said housing and said base plate are each dimensioned such that said housing is substantially rotatable within said base plate when said base plate is loosely attached to said mounting surface and such that said housing is substantially fixed when said base plate is tightly attached to said mounting surface.

2. The antenna mounting system of claim 1:

wherein said base plate further comprises a race disposed within said bottom surface;

wherein said housing further comprising a flange dimensioned to mate with said race such that said base plate captures said housing; and wherein said flange has a thickness that is greater than a depth of said race such that said housing is substantially rotatable within said base plate when said base plate is loosely attached to said mounting surface and such that said housing is substantially fixed when said base plate is tightly attached to said mounting surface.

3. The antenna mounting system of claim 2 further comprising a gasket;

wherein said gasket is manufactured of a compressible material and is dimensioned to extend about said bottom surface of said base plate; and wherein said flange of said housing has a thickness that is greater than a sum of said depth of said race and a fully compressed thickness of said gasket and less than a sum of said depth of said race and an uncompressed thickness of said gasket such that said housing is substantially rotatable within said base plate when said base plate is loosely attached to said mounting surface and such that said housing is substantially fixed, and said gasket creates a substantially water resistant seal, when said base plate is tightly attached to said mounting surface.

4. The antenna mounting system of claim 3 wherein said gasket is manufactured of a closed cell neoprene material.

5. The antenna mounting system of claim 1 wherein said attachment means for attaching said base plate to the mounting surface comprises at least two holes disposed through said base plate and at least two mechanical fasteners dimensioned for insertion through said holes, wherein said mechanical fasteners are adapted to be readily loosened and tightened.

6. The antenna mounting system of claim 1:

wherein said housing comprises a bolt opening and a fastener opening therethrough;

wherein said rotator portion of said rotatable connector comprises a bolt hole therethrough;

wherein said means for controlling a rotation of said rotator portion of said rotatable connector within said housing comprises a bolt dimensioned to extend through said bolt opening and said bolt hole, and a threaded fastener dimensioned to extend through said fastener opening and contact said rotator portion of said rotatable connector proximate to said bolt hole; and wherein said housing, said bolt and said threaded fastener are dimensioned such that tightening said bolt and said fastener causes said fastener to be drawn against said rotator portion such that said rotator portion is wedged between said threaded fastener and said interior of said housing.

7. The antenna mounting system of claim 1 further comprising a cable attached to said cable connector of said connector portion.

8. The antenna mounting system of claim 7 wherein said cable is fixedly connected to said cable connector.

9. The antenna mounting system of claim 8:

wherein a connection between said cable and said cable connector is sealed within said connector portion of said rotatable connector;

wherein said rotator portion of said rotatable connector comprises a notch therein; and wherein said cable extends from said connector portion of said rotatable connector, through said rotatable portion of said rotatable connector and exits said rotatable connector through said notch.

10. The antenna mounting system of claim 1 wherein said base plate and said housing are manufactured of a plastic material.

11. The antenna mounting system of claim 10 wherein said base plate and said housing are manufactured of a marine grade plastic that is resistant to ultraviolet radiation and is capable of being pigmented to produce a base plate and housing having a desired color.

12. The antenna mounting system of claim 1 further comprising an antenna.

13. The antenna mounting system of claim 1 wherein said cable connector comprises a male threaded end.

14. The antenna mounting system of claim 13 further comprising an antenna and a gasket, wherein said antenna comprises a female threaded connector mated with said male threaded end of said cable connector, and wherein said gasket is disposed between said antenna and said sealing surface of said connector portion of said rotatable connector.

15. A kit of parts for forming an antenna mounting system, said kit comprising:

a base plate comprising a bottom surface, a substantially circular opening through said bottom surface, and attachment means for attaching said base plate to a mounting surface;

a housing dimensioned to extend through said circular opening in said base plate and rotate therein, said housing comprising a substantially hollow interior defined by an interior surface, a bottom, and a top through which a slot is disposed;

a rotatable connector comprising a rotator portion and a connector portion, wherein said rotator portion is dimensioned for disposal within said interior of said housing and for rotatable attachment thereto, and wherein said connector portion is dimensioned to extend through said slot in said housing and comprises a cable connector and a sealing surface dimensioned to mate with an antenna; and means for controlling a rotation of said rotator portion of said rotatable connector within said housing;

wherein said housing and said base plate are each dimensioned for assembly such that said housing is substantially rotatable within said base plate when said base plate is loosely attached to said mounting surface and such that said housing is substantially fixed when said base plate is tightly attached to said mounting surface; and wherein said rotatable connector and said means for controlling a rotation of said rotator portion of said rotatable connector within said housing are dimensioned for assembly to said housing such that rotation of said rotatable connector may be stopped when said rotatable connector is in a desired orientation.

16. The kit of claim 15:

wherein said base plate further comprises a race disposed within said bottom surface;

wherein said housing further comprising a flange dimensioned to mate with said race such that said base plate captures said housing;

and wherein said flange has a thickness that is greater than a depth of said race such that said housing is substantially rotatable within said base plate when said base plate is loosely attached to said mounting surface and such that said housing is substantially fixed when said base plate is tightly attached to said mounting surface.

17. The kit of claim 16 further comprising a gasket;

wherein said gasket is manufactured of a compressible material and is dimensioned to extend about said bottom surface of said base plate; and wherein said flange of said housing has a thickness that is greater than a sum of said depth of said race and a fully compressed thickness of said gasket and less than a sum of said depth of said race and an uncompressed thickness of said gasket such that said housing is substantially rotatable within said base plate when said base plate is loosely attached to said mounting surface and such that said housing is substantially fixed, and said gasket creates a substantially water resistant seal, when said base plate is tightly attached to said mounting surface.

18. The kit of claim 15 wherein said housing comprises a bolt opening and a fastener opening therethrough;

wherein said rotator portion of said rotatable connector comprises a bolt hole therethrough;

wherein said means for controlling a rotation of said rotator portion of said rotatable connector within said housing comprises a bolt dimensioned to extend through said bolt opening and said bolt hole, and a threaded fastener dimensioned to extend through said fastener opening and contact said rotator portion of said rotatable connector proximate to said bolt hole; and wherein said housing, said bolt and said threaded fastener are dimensioned for assembly such that tightening said bolt and said fastener causes said fastener to be drawn against said rotator portion such that said rotator portion is wedged between said threaded fastener and said interior of said housing.

19. The kit of claim 15 further comprising a length of cable for attachment to said cable connector of said connector portion.

20. The kit of claim 15 further comprising an antenna.

* * * * *